United States Patent [19]

Rohde et al.

[11] 4,049,141

[45] Sept. 20, 1977

[54] METHOD OF CHARGING A PLURALITY OF COKING OVENS

[75] Inventors: Wolfgang Rohde; Werner Siebert, both of Essen, Germany

[73] Assignee: Bergwerksverband GmbH, Essen, Germany

[21] Appl. No.: 573,284

[22] Filed: Apr. 30, 1975

[30] Foreign Application Priority Data

May 4, 1974 Germany ..... 2421615

[51] Int. Cl.[2] ..... C10B 31/04

[52] U.S. Cl. ..... 214/152; 198/366; 202/262; 214/18 R; 214/18.2; 214/21; 214/35 R

[58] Field of Search ..... 214/16 R, 18 PH, 18.2, 214/21, 152, 18 R, 17 C, 17 CA, 35 R; 202/262; 198/366, 369, 540, 728, 733

[56] References Cited

U.S. PATENT DOCUMENTS

| | | | |
|---|---|---|---|
| 221,822 | 11/1879 | Howell | 198/728 X |
| 2,624,474 | 1/1953 | Hapman | 198/733 X |
| 3,244,298 | 4/1966 | Foard et al. | 214/21 UX |
| 3,567,048 | 3/1971 | Whitham | 214/16 R |
| 3,707,237 | 12/1972 | Wiemer | 214/21 |
| 3,880,720 | 4/1975 | Wagener et al. | 214/21 X |

*Primary Examiner*—Albert J. Makay
*Assistant Examiner*—Randolph A. Reese
*Attorney, Agent, or Firm*—Michael J. Striker

[57] ABSTRACT

A plurality of coking ovens are arranged in a horizontal row, and an endless scraper conveyor is mounted above the charging holes of the ovens and has an upper run and a lower run. A quantity of coal is admitted onto the lower run of the conveyor at one end portion thereof to be transported lengthwise of the row. Coal is charged from the lower run into respective ones of the ovens in a sequence which progresses from a downstream end of the row counter to the direction of transportation, and the charging of each oven is terminated when a signal is generated that indicates that a predetermined filling level in the oven has been reached.

9 Claims, 2 Drawing Figures

METHOD OF CHARGING A PLURALITY OF COKING OVENS

BACKGROUND OF THE INVENTION

The present invention relates to a method of charging coking ovens, and in particular to a method of charging a plurality of coking ovens which are arranged in a horizontal row.

Coke is usually produced in upright coking ovens which are arranged side-by-side in form of a row or battery. Each coking oven has an upper end provided with a charging hole that can be closed by a cover and through which coal is admitted into the coking oven for conversion into coke.

Various approaches are known in the prior art for charging the ovens with coal. The conventional way is by means of a larry car that travels on top of the coke oven row in a longitudinal direction and is provided with charging hoppers. Another proposal was made in U.S. Pat. No. 3,707,237 of Erich Wiemer which provides for connecting the outlet of a coal tower, bunker or an arrangement for preheating of coal with the coke ovens of a coke oven row or battery by means of a scraper conveyor and outlets which receive coal from the conveyor and discharge into the charging holes of the respective ovens. The scraper conveyor and its outlet or outlets are sealed against the ambient atmosphere to prevent the escape of charging gases that evolve during the charging of the respective ovens. To transport the coal to the respective outlets the scraper conveyor drags coal up to the respective outlet. When residual coal remains in the lower run during a change of charging from one to the next-following oven, and is transported along during charging of the next-following oven, in a direction towards the chain-reversing drum of the conveyor, this residual coal is to be transported by the chain-reversing drum from the lower run onto the upper run. There is also an alternative arrangement provided which effects this transportation from the lower run to the upper run in lieu of the drum.

However, while this proposal represents an improvement over the charging by means of a larry car, further improvements in the state of this art are still desirable.

SUMMARY OF THE INVENTION

Accordingly, it is an object of this invention to provide such further improvements.

More particularly, it is an object of the present invention to provide an improved method of charging plurality of coking ovens which are arranged in a horizontal row, by means of an endless scraper conveyor that is mounting above the charging holes of the ovens.

Another object of the invention is to provide such a method which allows proper charging of the ovens without being subject to malfunctions or the like.

In keeping with these objects, and with others which will become apparent hereafter, one feature of the invention resides in a method of charging a plurality of coking ovens arranged in a horizontal row by means of an endless scraper conveyor which is mounted above the charging holes of the ovens and has an upper run and a lower run. This method comprises the steps of admitting a quantity of coal onto the lower run of the scraper conveyor at one end portion thereof for transportation lengthwise of the row, charging coal from the lower run into respective ones of the ovens in a sequence which progresses from a downstream end of the row counter to the direction of transportation, and terminating the charging of each oven in response to generation of a signal indicating that a predetermined filling level has been reached.

When charging of a row of coking ovens by means of a conventional scraper conveyor is attempted, it has been found that the layer of coal that can be deposited on the support surface over which the links of the scraper chain are pulled, cannot have a thickness that is greater than the height of the respective run of the scraper chain. If the height is significantly increased above this thickness, any residual coal that is not discharged from the lower run of the conveyor and reaches the reversing drum at the downstream end of the conveyor, tends to block the rotation of the reversing drum and to necessitate a stoppage in the operation of the conveyor. Scraper conveyors of this type usually have chain links which have a height of approximately 5 cm. Filling the spaces between these links only to this height with coal, and given the fact that the scraper conveyor cannot advance particularly fast, it has also been found that the charging time required for charging any particular coking oven is relatively long. Moreover, it is difficult to admit a precisely predetermined amount of coal into the respective oven.

According to the present invention, however, these disadvantages can all be overcome. The quantity of coal which is admitted onto the lower run of the scraper conveyor should advantageously be such as to form on this lower run a coal layer whose thickness is substantially greater than the height of the lower run, preferably at least three times greater than the height of the lower run. Thereafter, coal is charged from this layer on the lower run into respective ovens of the row in such a sequence that when the coal is transported by the scraper conveyor in a direction opposite to the direction of the oven-filling sequence, the portions of the layer which have not been discharged into respective ones of the ovens and which, therefore, remain on the lower run and reach the chain-reversing roller at the downstream end of the conveyor, do not have a length greater than approximately 2 meters up to 7 meters, and preferably not greater than approximately 2.5 meters up to 5 meters. Furthermore, the charging of each oven is to be terminated, according to the present invention, in response to generation of a signal indicating that a predetermined filling level has been reached.

By resorting to the present invention, it is possible to significantly decrease the time required for charging any particular coking oven with coal. A common dimension for the chambers of such coking ovens is approximately 6000 mm high, 450 mm wide and 12 meters long. It has been found that an oven having these dimensions can be filled from a single scraper conveyor, if the method of the present invention is employed, within approximately 3–5 minutes. Of course, if two or more scraper conveyors are provided for filling purposes, then the filling time is correspondingly further decreased.

These results can be readily obtained with scraper conveyors having a width of between substantially 600 and 1000 cm, preferably about 700 mm, if the amount of coal that is poured onto the lower run of the scraper conveyor is such as to form thereon a coal layer having a thickness of between substantially 200 and 300 mm. Although this thickness is substantially in excess of the height of the links of the scraper chain of the scraper conveyor, the conveyor nevertheless scraps or drags the entire layer lengthwise of the conveyor trough or housing.

If residual quantities of this layer, i.e, quantities that have not been discharged into the respective coking ovens during their travel lengthwise of the lower run, are allowed to reach the chain-reversing drum at the downstream end of the scraper conveyor, this would inherently seem to bring with it the danger that they might block the further rotation of the drum and necessitate shutdown of the conveyor. However, according to the invention, it has been found that if these residual quantities of the layer have a length—as seen with respect to the elongation of the lower run—that is between substantially 2 and 7 meters, preferably between substantially 2.5 and 5 meters, blocking action which they tend to exert upon the reversing drum is not sufficient to prevent the conveyor drive from turning the drum despite the presence of this coal, so that the drum can continue to turn and can transport the coal from the lower run onto the upper run of the conveyor. The lengths of the residual portions of the coal are obtained, as previously indicated, by the two measures of selecting a charging sequence for the respective coking oven which progresses from a downstream end of the row of coking ovens counter to the direction of transportation of coal by the scraper conveyor, which is so selected that the maximum length of non-discharged portions of the coal layer on the lower run cannot exceed the above limits.

If, in contradistinction to the invention, the charging sequence into the ovens would be selected so that the ovens would be discharged sequentially in the same direction in which the coal is transported by the lower run of the scraper conveyor, there would be no residual coal remaining on the lower run (to be transported onto the upper run) since charging would progress from oven to oven sequentially in the direction of transportation. However, when the last oven of the row would be reached for charging, and the sequence would be begun again with the first oven of the row, then the entire length of the lower run would be filled with a layer of coal which could no longer be admitted into the last oven of the row and which could not be transported onto the upper run by the chain-reversing drum without causing a blockage of the latter. In contradistinction, by resorting to the present method and charging the ovens of the row in a sequence which progresses from a downstream end of the row counter to the direction in which the coal is being transported by the lower run of the scraper conveyor, residual quantities of coal (in form of coal-layer portions of a certain length) remain on the lower run as the charging progresses from one oven to the next oven of the sequence. These quantities or portions must then be transported by the chain-reversing drum from the lower run onto the upper run of the conveyor. However, by keeping the length of these portions within the aforementioned limits, this can be accomplished without any difficulty. Moreover, when the last oven of the sequence has been charged and the sequence begins again with the charging of the first oven of the sequence, no coal whatever remains in the lower run to be transported by the chain-reversing drum onto the upper run.

It is known from the prior art to charge coking ovens which are arranged in a row, in the following sequences (the numerals refer to oven numbers beginning at one end of the row): 1, 2, 3, 4, 5, etc; 1, 4, 7, 10-2, 5, 8, 11-3, 6, 9, 12; 1, 6, 11, 16-2, 7, 12, 17-3, 8, 13, 18-4, 9, 14, 19-5, 10, 15, 20; or 1, 82-, 93-, 10-4, 11-5, 12-16, 13-7, 14. The first charging sequence noted above has certain disadvantages in terms of the coking operation and is usually not utilized.

Particular sequences which are especially suitable to assure that the aforementioned lengths of residual coal layers are not exceeded, are the following: 1, 3, 5, 7-2, 4, 6, 8; 1, 3-2, 4, 6-5, 7, 9-8, 10, 12; 1, 4, 7, 10-2, 5, 8, 11 or similar sequences in which every second or every third oven of the row is charged in sequence.

The filling or charging sequence to be utilized depends of course on the outer width of the individual oven, which is usually approximately 1200 mm. If the ovens are wider than this, in which every second oven is charged is preferred to the type of sequence in which every third oven is charged.

Due to the intermittent return of residual quantities of coal from the lower run onto the upper run and back to the end portion of the conveyor where coal is admitted on the lower run, the total admission of coal onto the lower run varies. Because of this, the charging of each oven is supervised by a sensing arrangement which generates a signal indicating that a predetermined setting level has been reached, which signal can be utilized to stop the conveyor as soon as the desired filling in the particular oven has been achieved.

To avoid excessive loads upon the scraper conveyor, the coal which is admitted onto the lower run of the conveyor is dumped onto this lower run at one end portion of the conveyor through the upper run instead of being admitted onto the upstream end of the lower run so that the upper run at all times has to carry a complete layer of coal which would cause excessive wear of the conveyor components, including the chains and the reversing drums or sprockets.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
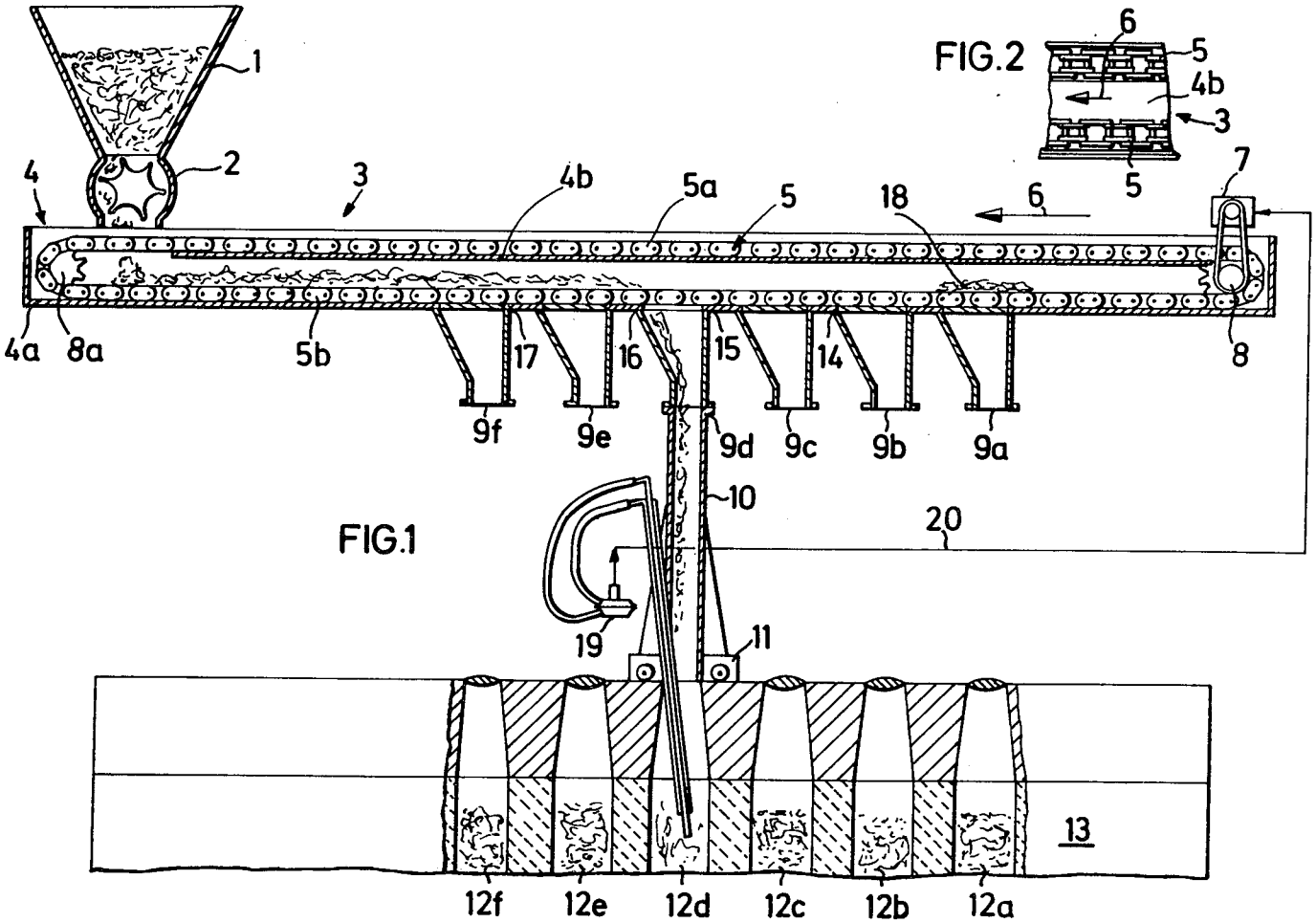
FIG. 1 is a somewhat diagrammatic partly sectioned side view illustrating an arrangement for carrying out the invention.
FIG. 2 is a fragmentary plan view of FIG. 1.

Reference numeral 13 identifies a diagrammatically illustrated coking oven battery which has a row of upright coking ovens, of these, coking ovens **12*a*, 12*b*, 12*c*, 12*d*, 12*e* and 12*f* have been illustrated by way of example. Each of the coking ovens 12*a*–12*f* has an upper open charging hole that can be closed by means of a cover in the manner known in the art. A carriage 11 can travel on the upper surface of the coking oven battery 13 if provided with a vertical conduit 10 can be placed into communication with the respective charging holes of the ovens 12*a*–12*f*. A sensing arrangement 19 is provided which operates on the pressure-transducer principle (known from the art) and which has been diagrammatically illustrated to indicate that the filling level of a particular oven 12*a*–12*f* can be sensed by the arrangement 19.**

Mounted above the battery 13, in a manner which is not illustrated in detail because it is known from the art, is a scraper conveyor 3 which receives at one of its end portions quantities of coal that are metered onto it by a metering dispenser 2 which receives the coal from the bunker 1. This coal may be preheated to approximately 150°-200° C, also in a manner known in the art.

The scraper conveyor 3 may be of the type disclosed in more detail in U.S. Pat. No. 3,707,237 which is herewith incorporated in its entirety by reference. It has a housing 4 that is preferably gas tight and includes a longitudinally extending bottom wall 4*a* and an intermediate partition wall 4*b* that extends only over part of the length of the housing 4. At the longitudinal ends of the housing 4 there are provided a reversing drum 8 and a chain sprocket 8*a*, respectively. Drum 8 is driven in rotation by an electric motor 7 which is connected by the circuit 20 with the sensing arrangement 19 so that, when a signal is originated in the arrangement 19 to indicate that the desired filling level of one of the ovens 12*a*-12*f* has been reached, the motor 7 will be deenergized by this signal. The circuitry for this is well known in the art and requires no detailed discussion.

As FIG. 2 indicates, the scraper conveyer 3 has two transversely spaced chains 5 connected (as disclosed in U.S. Pat. No. 3,707,237 and as also known per se in the art) by transverse scraper bars. The two chains 5 form an upper run 5*a* and a lower run 5*b* of the conveyor. The upper run 5*a* scrapes over the upwardly directed surface of the partition wall 4*b* and the lower run 5*b* scrapes over the upwardly directed surface of the lower wall 4*a* of the housing 4. Direction of advancement of the chains 5 is indicated by the arrow 6 in FIG. 1.

The dispensing device 2 discharges the coal through the interstices of the upper run 5*a* directly onto the lower run 5*b*, or rather onto the bottom wall 4*a* where it forms a layer having a height which is a multiple of the height of the chains of the lower run 5*b*, preferably equal to at least three times the height of the chains of the lower run 5*b*. The bottom wall 4*a* is provided with a plurality of outlets, of which outlets 9*a*-9*f* have been illustrated by way of example, and of which each is associated with one of the chambers of the ovens 12*a*-12*f*, respectively. These outlets 9*a*-9*f* can be blocked, for example by means of the gate valves disclosed in U.S. Pat. No. 3,707,237, and each of the outlets 9*a*-9*f* can be placed into communication with the charging hole of the chamber 12*a*-12*f* that is located directly beneath it, by moving the carriage 11 to a position in which the conduit 10 of the carriage communicates with the respective outlet and the respective charging hole. In FIG. 1, the conduit 10 is in a position in which it communicates with the outlet 9*d* and the cooperating charging hole of the oven 12*d*.

In FIG. 1, the oven 12*d* is being filled with coal that is pushed into the outlet 9*d* by the advancement of the lower run 5*b* in direction counter to the arrow 6. Prior to the filling of the oven 12*d*, the oven 12*b* was filled via the outlet 9*b*. After the filling of the oven 12*b* was completed and the outlet 9*b* was blocked again, a quantity 18 of residual coal remained on the lower run 5*b* intermediate the locations 14 and 15. During the further travel of the lower run 5*b* in direction counter to the arrow 6, namely as a result of this further travel which began when the filling of the oven 12*d* commenced, the quantity 18 has already traveled to the right of the point where it was previously located intermediate the locations 14 and 15 and approaches the reversing drum 8, which may be of the type disclosed in U.S. Pat. No. 3,707,237 and which serves to convey this quantity 18 onto the upper run 5*a* for travel in the direction of the arrow 6. According to the invention, the length of this residual quantity or portion 18 of the coal layer on the lower run 5*b*, as seen in direction lengthwise of the run 5*b*, should be between approximately 2 and 7 meters, preferably between approximately 2.5 and 5 meters. As long as it does not exceed this upper length limit, the portion 18 can still be conveyed by the reversing drum 8 onto the upper run 5*a* to be advanced by the same in the direction of the arrow 6 until it reaches the left-hand end of the partition wall 4*b* and can then drop through the interstices between the chains of the upper run 4*b* and onto the lower run 5*b*.

As soon as any particular oven 12*a*-12*f* (or any of the others of which the ovens 12*a*-12*f* are representative) has reached the desired filling level, the sensing arrangement 19 initiates the aforementioned signal which is supplied by the circuit 20 to the motor 7, causing the same to become deenergized so that the conveyor 3 stops. The outlet associated with just-filled oven (in FIG. 1 the outlet 9*d*) is then blocked again and the carriage 11 with the conduit 10 is advanced to the next oven of the sequence, in direction counter to the travel of the lower run 5*b*; in the example shown in FIG. 1, this next oven to be filled or charged will be the oven 12*f*. During the filling of the oven 12*f*, the residual portion of the layer which remains on the lower run 5*b* intermediate the locations 16 and 17 travels towards the reversing drum 8 to be conveyed by the same onto the upper run 5*a*.

After the filling of the oven 12*f* is completed, the carriage 11 is moved to a position in which the oven 12*c* can be filled and it can be readily seen that at this time no residual coal will remain on the lower run 5*b*. The filling sequence thus described requires filling every second oven, i.e., 12*b*, 12*d*, 12*f*, 12*c*, 12*e*, etc. However, any of the other sequences explained earlier can be used, as long as residual portions of the coal layer on the lower run 5*b*, as seen with reference to the elongation of the lower run 5*b*, is within the limits outlined earlier, i.e., between substantially 2 and 7 meters, and preferably between substantially 2.5 and 5 meters.

The method of the present invention can be utilized for charging coking ovens with various types of coal, e.g., with moist coal, with dry coal, or with dry coal that has been heated to a preheating temperature in excess of 100° C, for example 150°-200° C. It is advisable, as a general rule, to slightly wet the coal with an oil, for example with tar or a tar oil, in order to limit the development of dust clouds. In addition, this wetting with an oil or the like has the advantage that the wetting substance serves as a lubricant for the scraper conveyor.

It will be understood that each of the elements described above, or two or more together, may also find a useful application in other types of applications differing from the type described above.

While the invention has been illustrated and described as embodied in a method of charging a plurality of coking ovens arranged in a horizontal row, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of charging a plurality of coking ovens which are arranged in a horizontal row, by means of an endless scraper conveyor which extends along the row above the charging holes of the ovens and has an upper run and a lower run each extending from a first end portion of the conveyor adjacent one end of the row of ovens to a second end portion of the conveyor adjacent another end of the row of ovens, comprising the steps of admitting a quantity of coal at a location adjacent said first end portion through said upper run of said conveyor onto said lower run thereof; transporting the coal on said lower run lengthwise of said row in direction from said one end towards said other end of said row; charging coal from said lower run into the charging holes of said ovens in a sequence which begins with an oven closer to said other end than to said one end and which progresses counter to said direction of transportation to ovens which are successively closer to said one end while skipping intermediate ovens; terminating the charging of the respective ovens in response to generation of a signal indicating that a predetermined filling level has been reached in the charging hole of the oven; conveyinng any residual portions of the coal which have not been discharged from the lower run by the time respective increments of the lower run reach said second end portion of the conveyor, from said lower run onto said upper run and thereon counter to said direction towards said first end portion; and discharging said residual portions of coal from said upper run onto said lower run at said location adjacent said first end portion of the conveyor.

2. A method as defined in claim 1, wherein the step of admitting comprises depositing on the lower run a layer of coal having a thickness equal to at least three times the height of said lower run.

3. A method as defined in claim 2, said scraper conveyor having endless chains and a chain-reversing drum located at said second end portion and wherein the step of charging comprises discharging coal from said lower run into the respective ovens in such a sequence that portions of said layer which are not discharged into said ovens and reach said reversing drum have lengths of between substantially 2 and 7 meters as seen in direction of elongation of said lower run.

4. A method as defined in claim 3, wherein the step of charging comprises discharging coal into said ovens in a sequence beginning with a second oven at said other end of the row and progressing in direction toward said one end of the row to the fourth oven, the sixth oven, and so on.

5. A method as defined in claim 3, wherein the step of charging comprises discharging coal into said ovens in a sequence beginning at said other end with a first oven of the row and progressing in direction toward said one end of the row to the third oven, then reverting to the second, fourth and sixth ovens, the fifth, seventh and ninth ovens, the eighth, tenth and twelfth, and so on.

6. A method as defined in claim 3, wherein the step of charging comprises discharging coal into said ovens in a sequence beginning with a first oven at said other end of the row and progressing toward said one end of the row, to the fourth, seventh, and tenth ovens, then reverting to the second, fifth, eighth and eleventh ovens, and so on.

7. A method as defined in claim 3, and further comprising the step of stopping said scraper conveyor in response to the generation of said signal.

8. A method as defined in claim 2, said scraper conveyor having endless chains and a chain-reversing drum located at said second end portion and wherein the step of charging comprises discharging coal from said lower run into the respective ovens in such a sequence that portions of said layer which are not discharged into said ovens and reach said reversing drum have lengths of between substantially 2.5 and 5 meters as seen in direction of elongation of said lower run.

9. A method as defined in claim 3, wherein the step of charging comprises discharging coal into said ovens in a sequence beginning with a first oven at said other end of the row and progressing in direction toward said one end of the row to the third oven, the fifth oven, the seventh oven, and so on.

* * * * *

UNITED STATES PATENT AND TRADEMARK OFFICE

CERTIFICATE OF CORRECTION

PATENT NO. : 4,049,141

DATED : September 20, 1977

INVENTOR(S) : Wolfgang Rohde and Werner Siebert

It is certified that error appears in the above-identified patent and that said Letters Patent are hereby corrected as shown below:

On the title page

In the heading, the name and address of the second assignee should be added, and read -- Didier Engineering GmbH, Essen, Germany --.

Signed and Sealed this

*Twenty-first* Day of *September 1982*

[SEAL]

*Attest:*

GERALD J. MOSSINGHOFF

*Attesting Officer*

*Commissioner of Patents and Trademarks*